US005337436A

United States Patent [19]

Saxer et al.

[11] Patent Number: 5,337,436

[45] Date of Patent: Aug. 16, 1994

[54] BRUSHLESS TOOTH CLEANING DEVICE

[76] Inventors: Ulrich P. Saxer, Wirzenweid 55, Ch-8053 Zürich; Carlo A. Buzzi, Stauffacherstrasse 98, CH-8004 Zürich, both of Switzerland

[21] Appl. No.: 854,679

[22] PCT Filed: Sep. 2, 1991

[86] PCT No.: PCT/CH91/00186

§ 371 Date: Jun. 15, 1992

§ 102(e) Date: Jun. 15, 1992

[87] PCT Pub. No.: WO92/03947

PCT Pub. Date: Mar. 19, 1992

[30] Foreign Application Priority Data

Sep. 3, 1990 [CH] Switzerland ..... 2868/90-6

[51] Int. Cl.[5] ..... A47L 25/00

[52] U.S. Cl. ..... 15/104.94; 15/210.1; 601/139

[58] Field of Search ..... 15/104.94, 167.2, 176.1, 15/188, 210.1, 244.1-244.4; 128/62 A

[56] References Cited

U.S. PATENT DOCUMENTS

| | | | |
|---|---|---|---|
| 1,214,556 | 2/1917 | Le Vene et al. | 15/104.94 |
| 1,513,178 | 10/1924 | Mayhood | 15/210.1 |
| 1,661,713 | 3/1928 | Barker | 15/188 |
| 2,761,166 | 9/1956 | Connolly | 15/210.1 |
| 2,807,820 | 10/1957 | Dinhofer | 15/176.1 |
| 2,877,483 | 3/1959 | Alvistur | 15/244.1 |
| 3,029,809 | 4/1962 | Madlung | 15/244.1 |
| 3,087,183 | 4/1963 | Semon . | |
| 3,109,192 | 11/1963 | Levenson | 15/210.1 |
| 3,640,291 | 2/1972 | Mizuno | 15/167.2 |
| 4,221,015 | 9/1980 | Andersson | 15/244.1 |
| 4,428,091 | 1/1984 | Janssen . | |
| 4,585,416 | 4/1986 | DeNiro et al. | 128/62 A |

FOREIGN PATENT DOCUMENTS

| | | | |
|---|---|---|---|
| 2600234 | 7/1977 | Fed. Rep. of Germany . | |
| 1095847 | 6/1955 | France | 128/62 A |
| 1358278 | 3/1964 | France . | |
| 294895 | 12/1928 | United Kingdom . | |
| 1265270 | 3/1972 | United Kingdom . | |

*Primary Examiner*—Timothy F. Simone
*Assistant Examiner*—Mark Spisich
*Attorney, Agent, or Firm*—Rothwell, Figg, Ernst & Kurz

[57] ABSTRACT

The device has an elastic cleaning head with an aperture. On the inside facing the aperture there is a brushless cleaning layer (12), e.g. of looped fabric. For cleaning purposes the head is first fitted over an incisor (15) and moved to and fro, fully covering the teeth (15, 16) on three sides. The device is simple and economical to make and fully cleans the teeth without damaging the tooth surface.

8 Claims, 2 Drawing Sheets

BRUSHLESS TOOTH CLEANING DEVICE

BACKGROUND OF THE INVENTION

In general, people usually use a tooth brush to clean their teeth each day. The toothbrush commonly consists of a straight, angled, or bent handle, the end of which is designed as a brush. This brush can be equipped with bristles of varying hardness and shape, and the bristles may also be arranged in different ways. Recently a replaceable brush head, which has many advantages from the standpoint of hygiene, has also been proposed. Since the head has to be not only attached to the handle in such a way as to be separable, but also must be fastened to the handle securely enough to follow all the motions of the brush during tooth brushing without slipping, creating a competitively priced embodiment may pose some problems.

On the other hand, different designs previously have been proposed for a cleaning device in the form of an extended thimble with a textile or other rough surface which can, if necessary, be impregnated with a tooth cleansing agent. This device, which is based on the primitive method of cleaning one's teeth by rubbing them with a finger when no toothbrush is available, has been rejected by the dental profession as inadequate.

Based on recent scientific findings, it has been determined that regularly brushing teeth vigorously for minutes at a time, even with soft brushes, can lead to microfine scratching of the tooth surface. This is particularly the case after the consumption of acidic foods, which can temporarily soften the dental enamel, as well as when the dental necks and tooth root surfaces are exposed and devoid of enamel.

SUMMARY OF THE INVENTION

The goal of the present invention is thus to create a simple, brushless cleaning device which is simple and reasonably economical to produce so that it would naturally occur to the user to dispose of it in its entirety after using it one or :more times, but only after several months or, in the case of an embodiment with a replaceable head, to replace the head after each use or after a few uses. Another goal was to design the device in such a way that it would do absolutely no damage to the tooth surface or gums.

The cleaning device of the present invention accomplishes these goals due in part to the device's elasticity, which makes possible a design that fully envelops at least one tooth on three sides simultaneously, namely the bite surface, the outside, and the inside, ensures constant contact between the tooth surface and the device's cleaning surface during the cleaning motion, and makes it possible to adapt automatically to the different shapes of the teeth, e.g., when moving from the incisors to the molars. The fitting of the device onto the teeth is done through an opening that is present in the device. The opening is placed on an incisor, whereupon the device and the head are pushed backward until they envelop the tooth over its full height and grip somewhat below the edge of the gum. Moving the device back and forth creates friction over the entire surface of the tooth (with the exception of the spaces between the teeth), which gently removes plaque and other deposits without damaging the enamel.

In one embodiment of the present invention, an elongated block made of an elastic material is used without a holder. On one side the block has a longitudinal through-hole which is fitted over the teeth. Because of the flexibility of the material, the block, which covers several teeth at once, follows the curve of the palate and, during the back and forth cleaning motion, adapts to the corresponding shapes of the jaw and the teeth. A particularly suitable material for this embodiment is self-skinning foam.

In another embodiment of the present invention, a cleaning head is separably connected to a holder. Elasticity is ensured either by the properties of the material of which the head is made and/or by the resilience of the holder. The head should preferably be round or square and generally covers one or two teeth.

The securing of the head to or on the holder can be done using known means, e.g., a push-button system, a screw system, a snap mechanism, etc.

The head is preferably be made of, for example, foam, self-skinning foam, rubber, silicone rubber, etc. It should preferably be made of a multilayer material, e.g., a resilient outer layer, a very elastic middle layer, and an inner layer that is to be brought into contact with the tooth surface; this inner layer can be made of, e.g., foam with a rough surface, textiles such as corduroy, velvet, terrycloth, or other looped fabrics, felt, or flock and similar materials or matted formed fabric, gathered dental floss, etc.

BRIEF DESCRIPTION OF THE DRAWINGS

The invention is described below in greater detail using several embodiments as examples, in which.

DETAILED DESCRIPTION OF THE PREFERRED EMBODIMENTS

Figure 1A:
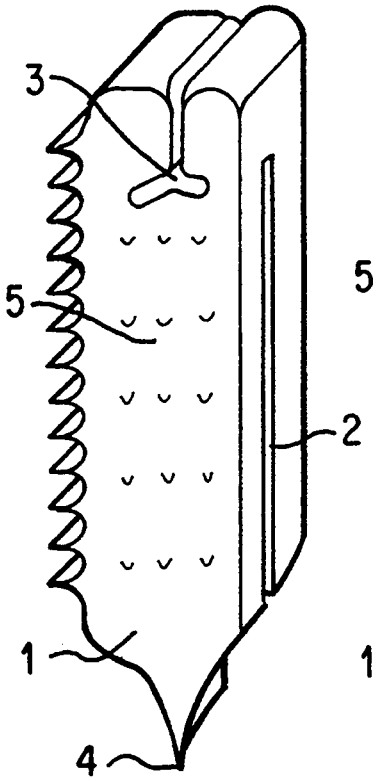
FIG. 1*a* shows a first embodiment of the present invention.
Figure 1B:
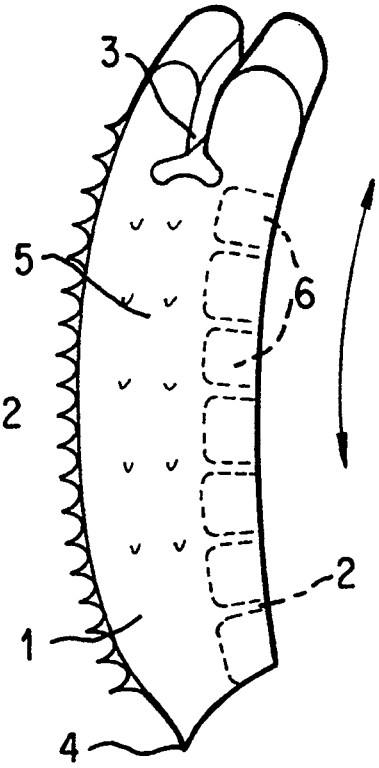
FIG. 1*b* shows the embodiment of FIG. 1*a* fitted over several teeth.

FIGS. 1*a* and 1*b* a cleaning block 1 made of self-skinning foam which is equipped with a lateral opening 2 and an opening 3 at one end. The other end is made in the shape of a wedge or spike 4 with which the spaces between the teeth can be cleaned. The opening 2 is used to fit the cleaning block onto the teeth, in which case several teeth in the lower jaw are covered from above and several teeth in the upper jaw are covered from below simultaneously. The purpose of the opening 3 is to fit the device over at least one tooth. To achieve particularly good cleaning results, these openings 2, 3 have a rough surface, e.g., ribbed, serrated, or knotted.

For tooth cleaning, the device is fitted over the teeth 6 with, if desired, a cleansing agent squeezed into the opening, and moved back and forth manually. If so desired, the surfaces 5 that do not come into contact with the teeth or jaws may be uneven, e.g., roughened, ribbed, etc. in order to afford the fingers a better grip.

Figure 2:
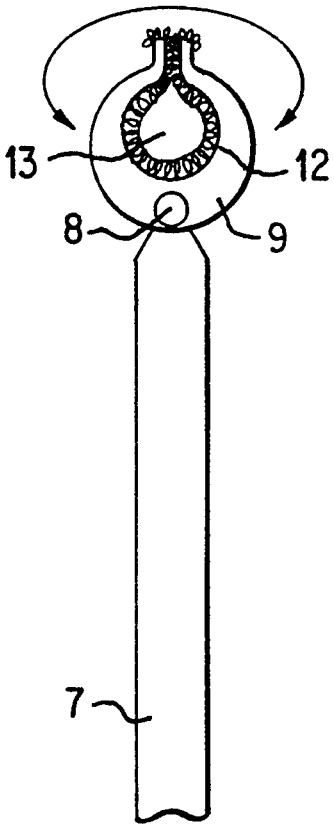
FIG. 2 shows, in section, a second embodiment of the present invention with a swivel-mounted cleaning head made of an elastic material.

FIG. 2 shows a second embodiment including a rigid and, if necessary, angled holder 7, similar to the handle of a toothbrush, one end of which is equipped with a ball 8 on which the elastic head 9 is swivel-mounted and from which it can be detached and changed. Some other removable means of attachment, e.g., a screw, a ball-and-socket joint, a push-button, etc., may also be used instead of the ball 8.

The cleaning head 9 should preferably be round but may be of another shape. Instead of the means of attachment 8 on the holder, the means of attachment may also be mounted on the head. In this case (not depicted), of course, the head end of the holder must be equipped with the corresponding receiving opening. The material for cleaning the teeth as well as a replaceable insert 12 may be separably secured in the opening 13 by means of, e.g., "VELCRO". This variant may also be used with all other embodiments.

Figure 4A:
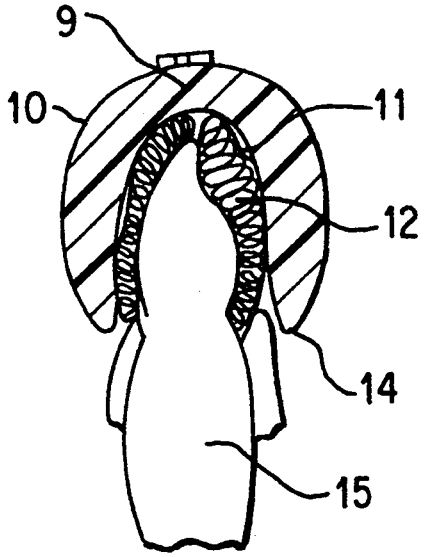
FIG. 4*a* shows, in section, the embodiment of FIG. 2, fitted onto an incisor.
Figure 4B:
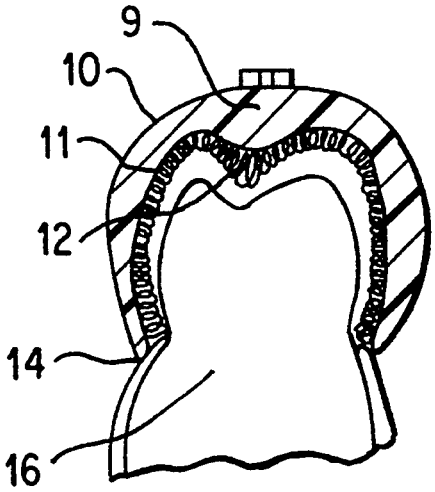
FIG. 4*b* shows the same cleaning head as in FIG. 4*a* after it is moved further back onto a molar.

FIGS. 4*a* and 4*b* show a head 9 fitted onto an incisor 15 (FIG. 4*a*) and onto a molar 16 (FIG. 4*b*). The round head 9 is surrounded by a resilient outer casing 10 made of, e.g., self-skinning foam, onto which an intermediate layer 11 made of an elastic plastic, rubber, silicone rubber, etc. is applied. An inner cleaning layer 12, which is made of velvet, corduroy, flock, terrycloth, matted formed fabric, etc. and which, if necessary, may be impregnated with a tooth cleansing agent, is connected to the layer 11. If so desired, the intermediate layer 11 may also be provided with a tooth-cleansing agent by placing the cleanser on the device before use, in which case a repository is created which is gradually emptied. A single-layer head may also be used instead of a multilayer one. The surface that comes into contact with the tooth must, however, be such that, as the head passes back and forth over the tooth, the tooth surface is mechanically cleaned by friction on all three contact sides (the chewing surface and the surfaces facing the lips and the tongue) without damaging the tooth.

The dimensions of the head are selected to be such that the end parts 14 of the cleaning head extend somewhat over or under the gums on both sides. In order to keep the gums from being injured, care must be taken to ensure that these end parts are made soft; if need be, this can be done with a special coating.

To clean teeth, the head 9 mounted on the holder 7 is first placed on an incisor, whose thin cutting surface can be easily introduced into the opening 13. The head is gently forced onto the tooth until the end parts 14 have reached the desired depth. Moving the head back and forth on the tooth ensures quick, easy, and highly effective cleaning. After the head is moved back and forth several times, it and the holder are pushed onto the next tooth, which in turn is cleaned in the same way, etc. At the last tooth, the device is withdrawn and shifted to clean the other half or the upper half of the teeth. FIG. 4*a* shows the head fitted on an incisor 15, and FIG. 4*b* shows it fitted on a molar 16. The considerably wider and deeper molar 16 compresses the elastic middle layer 11 and distends the outer casing 10 accordingly.

Figure 3:
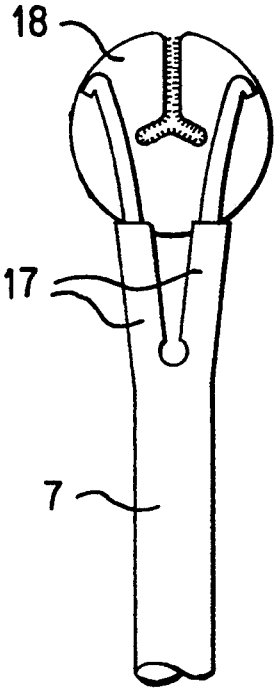
FIG. 3 shows in section, a third embodiment of the present invention with a flexible fork and an elastic cleaning head mounted on the tips of the prongs.
Figure 5:
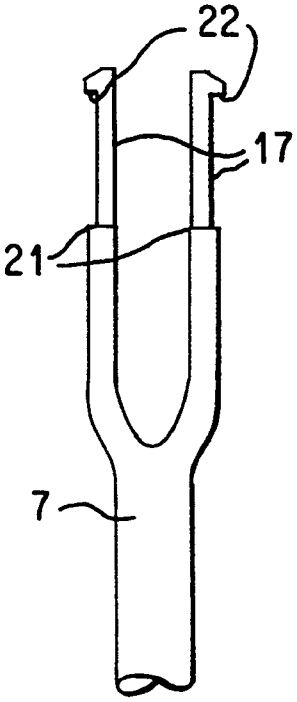
FIG. 5 is a view of a fork.
Figure 6:
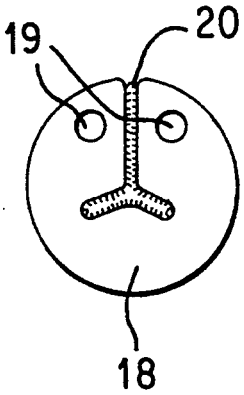
FIG. 6 shows, in section the cleaning head corresponding to the embodiment shown in FIG. 3.

In another embodiment (FIG. 3) , the holder 7 is equipped with a flexible clamping fork 17. The prongs of the fork 17 are shaped in such a way that they can be run through the corresponding holes 19 in the cleaning head 18. An exemplary embodiment of this fork is shown in FIG. 5. The enlargement 21 prevents any further movement of the head, which is clamped by the barbed ends 22 of the prongs. The head can be replaced with a gentle tug to overcome the clamping action. The head 18 is compressed by the prongs of the fork 17 in the direction indicated by the arrows. After the device is placed on the tooth, a corresponding pressure develops on the tooth. The connection between the head and the fork may also be a catch.

Instead of being a fork, the support may also be designed in the form of pliers or forceps. This embodiment makes it possible to adjust the pressure exerted by the head and allows, for example, an almost zero-pressure massage of the gums.

The cleaning heads 18 which are equipped with two holes 19 and an opening 20 and which are to be mounted on these kinds of fork-shaped, pliers-shaped, or forceps-shaped supports may, in turn, be made of the same materials as mentioned above and may also consist of several layers. Since the resilience is provided by the holder itself, their elasticity may be less than in the embodiment of FIG. 4.

We claim:

1. A tooth-cleaning apparatus comprising:

a cleaning head attached to a holder, said holder facilitating movement and manipulation of the cleaning head along a user's teeth to mechanically clean said teeth;

said cleaning head being free of bristles and having an opening defining a recess formed therein for receiving a first tooth having a chewing surface and two side surface, said recess permitting the cleaning head to be positioned over said first tooth so as to substantially completely surround the three tooth surfaces;

said cleaning head formed of a flexible material to permit the recess of the cleaning head to e positioned over said first tooth and moved to a second tooth having a larger size than the first tooth so as to substantially completely cover three surfaces of the second tooth; and said recess having a flock material extending from and substantially covering all surfaces of said recess for mechanically cleaning said teeth without damaging the surfaces of said teeth or the gums of the user.

2. The apparatus of claim 1, wherein the cleaning head is detachable and can be removed from the holder to allow another cleaning head to be attached to the holder.

3. The apparatus of claim 2, wherein the holder is rigid, and the cleaning head is elastic and wherein there is at least one intermediate layer disposed between said cleaning head and said flock material, the cleaning head being less elastic than said at least one intermediate layer and said flock material.

4. The apparatus of claim 2, or 3, wherein the head is swivel-mounted on the holder.

5. The apparatus of claim 2, wherein the holder has a bifurcated end portion with free ends movable toward and away from each other, the free ends being separately attached to the cleaning head.

6. The apparatus of claim 5 wherein the cleaning head is provided with apertures which receive the respective free ends of the holder.

7. The apparatus of claim 2, wherein the flock material which contacts the user's teeth is impregnated with a cleaning agent.

8. The apparatus of claim 1, wherein the flock material is separably secured in the recess.

* * * * *

UNITED STATES PATENT AND TRADEMARK OFFICE

CERTIFICATE OF CORRECTION

PATENT NO. : 5,337,436

DATED : August 16, 1994

INVENTOR(S) : Ulrich P. Saxer et al.

It is certified that error appears in the above-indentified patent and that said Letters Patent is hereby corrected as shown below:

Col. 4, line 29, "surface" should be --surfaces--.

Col. 4, line 34, "to e" should be --to be--.

Signed and Sealed this

Eleventh Day of April, 1995

*Attest:*

*Attesting Officer*

BRUCE LEHMAN

*Commissioner of Patents and Trademarks*